US006137348A

United States Patent [19]

Uchida et al.

[11] Patent Number: 6,137,348

[45] Date of Patent: Oct. 24, 2000

[54] SEMICONDUCTOR DEVICE FOR GENERATING TWO OR MORE DIFFERENT INTERNAL VOLTAGES

[75] Inventors: Toshiya Uchida; Yoshimasa Yagishita, both of Kawasaki, Japan

[73] Assignee: Fujitsu Limited, Kanagawa, Japan

[21] Appl. No.: 09/204,171

[22] Filed: Dec. 3, 1998

[30] Foreign Application Priority Data

Jul. 21, 1998 [JP] Japan ..... 10-204847

[51] Int. Cl.[7] ..... G05F 1/10

[52] U.S. Cl. ..... 327/541; 327/543

[58] Field of Search ..... 327/530, 538, 327/540, 541, 543, 545; 365/226

[56] References Cited

U.S. PATENT DOCUMENTS 5,812,017 9/1998 Golla et al. ..... 327/540

5,856,756 1/1999 Sasahara et al. ..... 327/540

5,942,809 8/1999 Hashimoto ..... 327/540

*Primary Examiner*—Jung Ho Kim

*Attorney, Agent, or Firm*—Arent Fox Kintner Plotkin & Kahn, PLLC

[57] ABSTRACT

A novel semiconductor device having two different power circuits is disclosed. Even if the output of the stage before a voltage conversion circuit declines due to the decline of the level of the power circuits or the voltage drop through a resistor, the voltage conversion circuit performs a normal operation. The semiconductor device comprises a first power circuit for generating a first source voltage, a second power circuit for generating a second source voltage higher than the first source voltage, and a second power level detection circuit for detecting the second source voltage. The first power circuit changes the first source voltage in accordance with the result of detection by the second power level detection circuit.

20 Claims, 8 Drawing Sheets

SEMICONDUCTOR DEVICE FOR GENERATING TWO OR MORE DIFFERENT INTERNAL VOLTAGES

BACKGROUND OF THE INVENTION

The present invention relates to a semiconductor device for generating at least two different internal source voltages or, in particular, to a dynamic random access memory (DRAM) having a boosting circuit capable of being tested even when the output of the boosting circuit drops temporarily under an overloaded state.

In recent years, a semiconductor device, or especially a DRAM, has used, as a source voltage, the power supplied from an external source dropped by an internal power supply for reducing the current consumption of the DRAM. The internal power supply will hereinafter be called the VII power supply and the source voltage generated therein the VII. Also, in the DRAM, a 100% charge is accumulated in a memory cell configured of a NMOS transistor, and in order to improve the operating characteristic and stability, a word line supplying a gate voltage of a cell transistor is set to a potential not lower than an external source voltage. For this purpose, the boosting circuit is provided. The power supplied from the boosting circuit will hereinafter be called the VPP power supply, and the voltage generated therein and higher than the external source voltage will be called the VPP. In the case where a device has an internal power circuit for generating two different positive source voltages, circuits coexist which are operated by different power supplies, and a signal may be input from one circuit to the other. In such a case, the potential levels of the signals fail to coincide and therefore voltage conversion is necessary.

The boosting circuit for generating the VPP power has a complicated configuration and is low in conversion efficiency. Also, a boosting circuit having a large output capacity is bulky in circuit size. In view of this, as few circuits using the VPP power supply as possible are employed, and the VII power supply is used as far as possible for those parts where such power is usable. The capacity of the VPP power supply is set as required. Normally, the voltage of the VPP power supply does not drop so much. When testing a product, however, an extremely large load capacity may be driven. In such a case, a large current flows and a voltage drop occurs. This phenomenon may develop as a transient phenomenon in the normal operation as well as at the time of testing a product. Once such a voltage drop occurs, the transistor in the conversion circuit fails to turn off completely and a short-circuit current flows so that the signal fails to drop to the ground level completely. This short-circuit current enhances the voltage drop and the decline of the output level of the VPP power supply itself. In other words, once a short-circuit current begins to flow, even though a transient phenomenon, the voltage drop caused by the short-circuit current enhances the short-circuit current, and the normal state cannot be restored.

Methods have been conceived to obviate this problem. One of them consists of increasing the capacity of the VPP power supply in order to prevent the decline of the level of the VPP power supply. Another method consists of avoiding the voltage conversion from the signal of the VPP power supply to the signal of the VII power supply. Still another method is using a complicated circuit for voltage conversion, if required, from the signal of the VPP power supply to the signal of the VII power supply. These methods, however, require a considerably redundant circuit design of a semiconductor device and cannot be recommended from the viewpoint of device performance and high integration.

SUMMARY OF THE INVENTION

The object of the present invention is to solve this problem and provide a semiconductor device having two different power circuits, in which even when the output in the stage before a voltage conversion circuit decreases due to the decline of the level of the power circuits or the voltage drop through a resistor, the voltage conversion circuit performs a normal operation.

According to the present invention, there is provided a semiconductor device comprising a first power circuit for generating a first source voltage, a second power circuit for generating a second source voltage higher than the first source voltage, and a second power level detection circuit for detecting the second source voltage, wherein the first power circuit changes the first source voltage in accordance with the result of the detection by the second power level detection circuit.

The first source voltage generated in the first power circuit is reduced in accordance with the reduction in the second source voltage so that the first source voltage is always lower than the second source voltage. Consequently, in the case where the output level (second source voltage) of the second power circuit drops, the output level (first source voltage) of the first power circuit also drops, with the result that the threshold level of an invertor connected to the first source voltage is reduced thereby to turn off the transistor completely.

BRIEF DESCRIPTION OF THE DRAWINGS

The present invention will be more clearly understood from the description as set below, with reference to the accompanying drawings, wherein.

DESCRIPTION OF THE PREFERRED EMBODIMENTS

Before proceeding to a detailed description of the preferred embodiments, a conventional semiconductor device having at least two sources of different voltages will be described with reference to the accompanying drawings for a clearer understanding of the differences between the conventional technology and the present invention.

Figure 1:
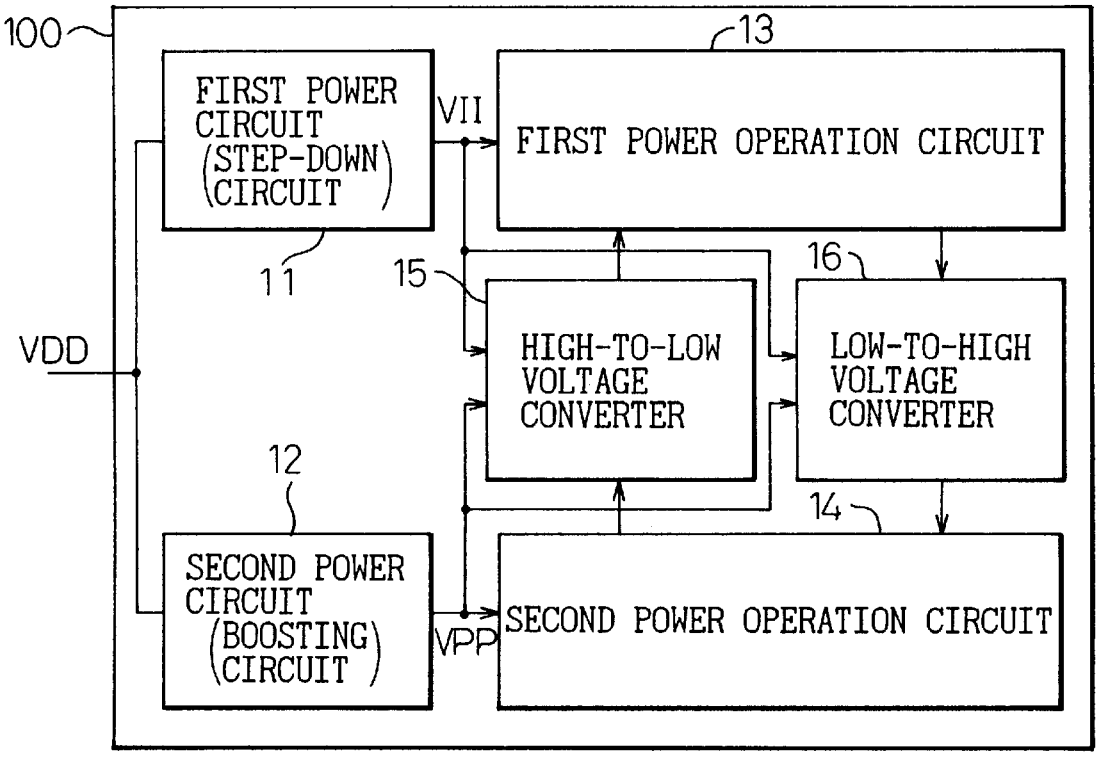
FIG. 1 is a diagram showing an example configuration of a semiconductor device having power supplies of different voltages.

FIG. 1 is a block diagram showing an example configuration of a semiconductor device having at least two different power circuits. A first power circuit 11 is a step-down circuit for decreasing an external source voltage VDD and generating the VII power of a voltage lower than VDD. This circuit is so configured that, for example, the drain of an NMOS transistor is connected to the VDD and a predetermined voltage internally generated is applied to the gate thereof, or a reference potential generating circuit and a current amplifier circuit described later are combined. The potential of the VII power output is lower, by the threshold of a transistor than a predetermined voltage applied to the gate, and remains constant unless the VDD drops extremely. A second power circuit 12 is a boosting circuit for generating a VPP power higher than the external power VDD by boosting the VDD. This circuit can be realized by combining, for example, an oscillator circuit and a charge pump circuit. A first power operation circuit 13 is a circuit operated by the VII power supply. A second power operation circuit 14 is a circuit operated by the VPP power supply. A high-to-low voltage conversion circuit 15 is a circuit for converting the signal generated in the second power operation circuit 14 into a signal of the VII power supply suitable for the first power operation circuit 13 before being supplied to the first power operation circuit 13. A low-to-high voltage conversion circuit 16 is a circuit for converting the signal generated in the first power operation circuit 13 into a signal of the VPP power supply suitable for the second power operation circuit 14 before being supplied to the second power operation circuit 14.

Figure 2A:
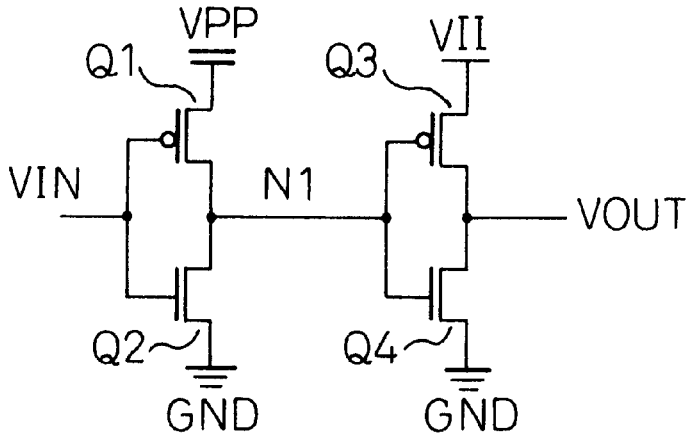
FIGS. 2A to 2C are diagrams showing example configurations of a voltage conversion circuit.
Figure 2B:
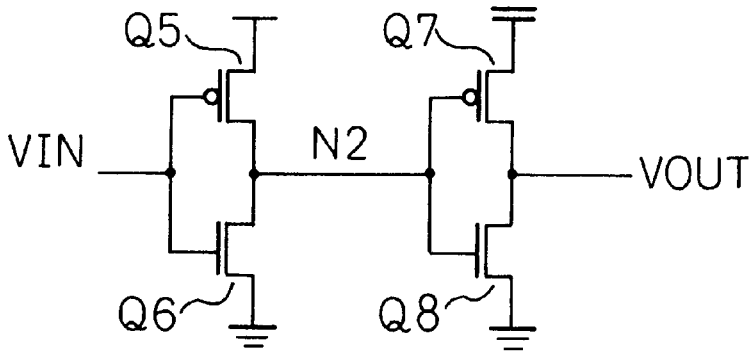
Figure 2C:
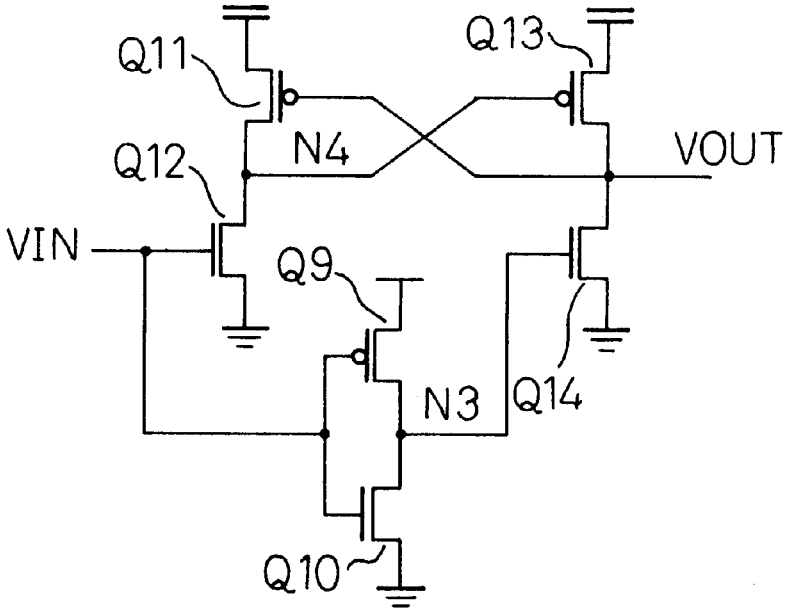

Generally, the step-down circuit is simple in configuration and can be easily realized with a large output capacity. The boosting circuit, in contrast, is complicated in configuration and low in conversion efficiency. A boosting circuit having a large output capacity is bulky in circuit size. Therefore, as few circuits as possible are employed using the VPP power supply, and the output capacity of the boosting circuit is set to a required minimum level. FIGS. 2A to 2C are diagrams showing conventional examples of the voltage conversion circuit between the voltage VII and the voltage VPP. The high-to-low voltage conversion circuit 15 for converting a signal of the VPP power supply to a signal of the VII power supply normally uses the voltage conversion circuit of FIG. 2A. The VPP power supply is higher in potential than the VII power supply. When the input VIN is low (L), therefore, a transistor Q1 turns on and a transistor Q2 turns off, so that a signal N1 turns high (H). Accordingly, the transistor Q3 turns off and the transistor Q4 turns on. The level of N1 is sufficiently high to turn off the transistor Q3 with VPP, with the result that VOUT turns L. Of course, in the case where VIN is H and N1 is L, VOUT is H and the level thereof is VII.

The voltage conversion circuit of FIG. 2A cannot be used as a low-to-high voltage conversion circuit 16 for converting the signal of the VII power supply to the signal of the VPP power supply. FIG. 2B shows the case in which the voltage conversion circuit of FIG. 2A is used as a low-to-high voltage conversion circuit 16. When the input VIN is low (L), the transistor Q5 turns on and the transistor Q6 turns off, so that the signal N2 turns high (H). The level of this signal, however, is not sufficient to turn off the transistor Q7 with VII, with the result that the transistors Q7 and Q8 both turn on. Thus, a short-circuit current flows through, these transistors, and the output VOUT undesirably assumes an intermediate level.

In view of this, the voltage conversion circuit of FIG. 2C is used as a low-to-high voltage conversion circuit 16 for converting the signal of the VII power supply to the signal of the VPP power supply. When the input VIN is low (L), the transistor Q12 turns off, so that the current for drawing the signal N4 to the ground level is stopped. At the same time, the transistor Q9 turns on and the transistor Q10 turns off, so that the signal N3 turns H. The transistor Q14 thus turns on thereby to decrease the output VOUT. Since the transistor Q13 is still on, a short-circuit current flows in the transistors Q13 and Q14. The output VOUT, however, drops to a voltage level determined by the ratio of resistance between the transistors Q13 and Q14, thereby turning on the transistor Q11. Once the transistor Q11 turns on, the potential of the signal N4 is increased toward VPP thereby to turn off the transistor Q13 since the transistor Q12 is off. As a result, the short-circuit current ceases to flow in the output VOUT, which turns to L (ground) level. When the input VIN is H, the reverse is true.

As described above, the voltage conversion circuit of FIG. 2C, which can be used as a voltage conversion circuit for converting the signal of the VII power supply to the signal of the VPP power supply, has such a circuit operation that it can also be used as a voltage conversion circuit for converting the signal of the VPP power supply to the signal of the VII power supply. In this way, the circuits of FIGS. 2A and 2C can both be used as a voltage conversion circuit for converting the signal of the VPP power supply to the signal of the VII power supply, although the circuit of FIG. 2C has two more elements (transistors). From the viewpoint of the high integration of elements, therefore, the voltage conversion circuit of FIG. 2A is used for converting the signal of the VPP power supply to the signal of the VII power supply, and the voltage conversion circuit of FIG. 2C is used for converting the signal of the VII power supply to the signal of the VPP power supply.

Figure 3:
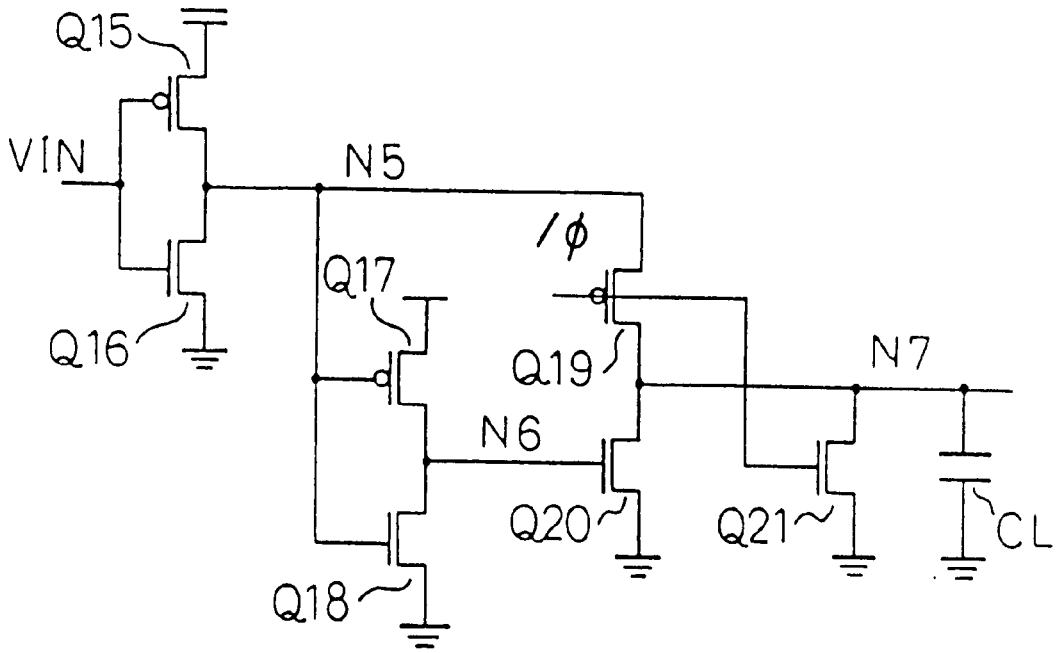
FIG. 3 is a diagram showing an example of coexisting circuits operated by different source voltages.

As described above, the boosting circuit for generating the VPP power is complicated in configuration and low in conversion efficiency, and a boosting circuit having a large output capacity is bulky. In view of this, as few circuits as possible are employed using the VPP power supply, and the VII power supply is used as far as possible. FIG. 3 is a diagram showing an example of such a circuit.

The circuit of FIG. 3 is for applying VPP to, and discharging it from, a load capacitor CL in accordance with the input VIN and the signal /ϕ. When the input VIN is L and /ϕ is L, the load capacitor CL is charged to the source voltage VPP through the transistors Q15 and Q19, while when VIN and /ϕ are H, the load capacitor CL is discharged to the ground level. The signal of the VII power supply is used as a signal N6 applied to the gate of the transistor Q20 for discharge. An inverter including transistors Q17 and Q18 is used for converting the signal N5 of the VPP power supply to the signal N6 of the VII power supply. In other words, the portion configured of the transistors Q15, Q16, Q17, Q18 constitutes the voltage conversion circuit of FIG. 2A.

In the case where the load capacitor CL is so large that a large charge current flows, a large current flows in the transistors Q15 and Q19 and a voltage drop occurs. This voltage drop makes it difficult for the potential of the signal N5 to rise. Also, the large charge current makes it necessary that the boosting circuit for generating the VPP power supplies this charge current. In the case where such power is in short supply, the voltage across the VPP power supply also drops. As a result, it is more difficult to increase the potential of the signal N5. As described above, the capacity of the power supply VPP is set in accordance with the capacity requirement. Normally, the voltage across the VPP power supply rarely drops in a large measure. At the time of testing a product as described later, however, an extremely large load capacitor CL may be driven. Not only in such cases but in normal operation as well, the signal N5 may fail to rise to a sufficiently high level as a transient phenomenon.

Figure 4:
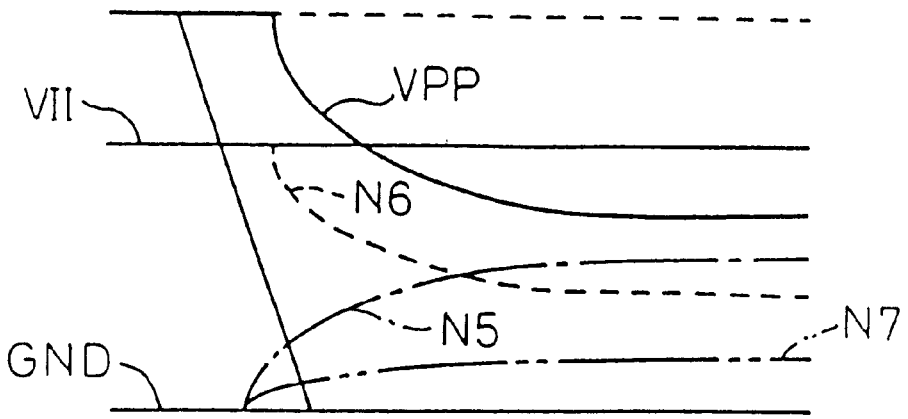
FIG. 4 is a diagram showing the operation when the voltage VPP drops in the circuits of FIG. 3.

FIG. 4 is a diagram showing an operating voltage waveform produced in the case where the potential of the VPP power supply drops and the signal N5 fails to rise to a sufficient level in the circuit of FIG. 3. In the circuit of FIG. 3, assume that the signal N5 fails to rise to a sufficient level or especially that the signal N5 rises only to a potential lower than VII for the reason described above. The transistor Q17 fails to turn off completely, and a short-circuit current flows in the transistors Q17 and Q18, so that the signal N6 fails to drop completely to the ground level. In such a case, it becomes impossible to completely turn off the transistor Q20, and a short-circuit current flows also in the transistor Q20 through the transistors Q15 and Q19. This short-circuit current, together with the charge current of the load capacitor CL, enhances the voltage drop due to the transistors Q15 and Q19 and the decline of the output level of the VPP power supply itself. In this way, once the short-circuit current begins to flow, even though a transient phenomenon, the resulting voltage drop enhances the short-circuit current, thereby making it impossible to restore the normal state. A similar problem occurs if the voltage-converted signal N6 supplied to the first power operation circuit 13 fails to drop completely to the ground level but remains at an intermediate level.

Figure 5:
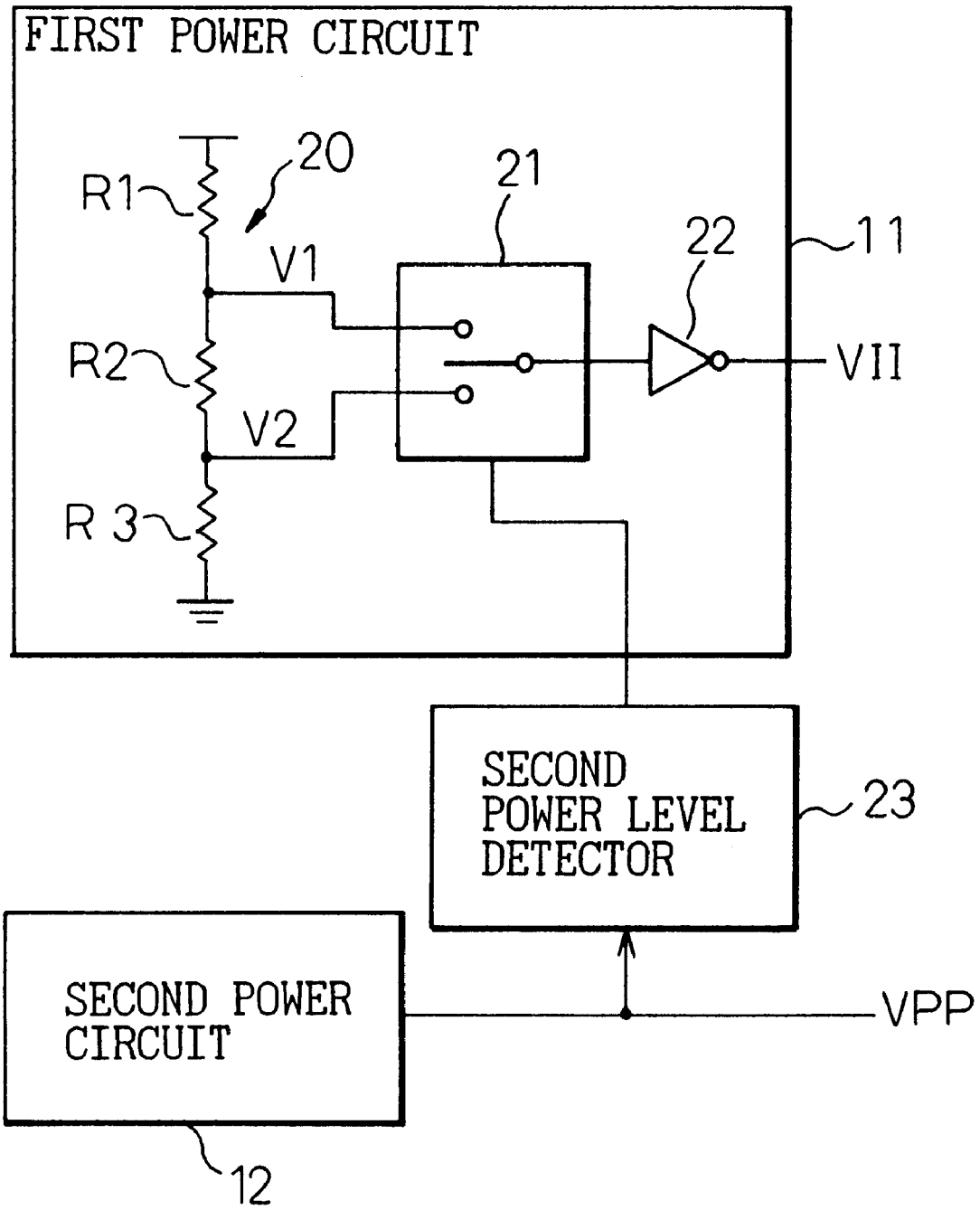
FIG. 5 is a diagram showing a basic configuration of a semiconductor device according to this invention.

FIG. 5 is a diagram showing a basic configuration of a semiconductor device according to this invention. As shown, a semiconductor according to the invention comprises a first power circuit 11 for generating a first source voltage, a second power circuit 12 for generating a second source voltage higher than the first source voltage, and a second power level detection circuit 23 for detecting the second source voltage, wherein the first power circuit 11 changes the first source voltage in accordance with the result of detection by the second power level detection circuit 23.

The first source voltage generated in the first power circuit 11 is lowered in accordance with the drop of the second source voltage so that the first source voltage is always lower than the second source voltage. As a result, in the case where the output level of the second power circuit (second source voltage) drops, the output level of the first power circuit (first source voltage) also drops, so that the threshold level of the inverter connected to the first source voltage is reduced.

Assume that the semiconductor device, as shown in FIGS. 2 and 3, comprises a logic circuit having a voltage conversion function including a first logic gate supplied by the second source voltage and a second logic gate supplied by the first source voltage and with an input thereof connected to the output of the first logic gate. As a result of lowering the threshold level of the invertor connected to the first source voltage described above, even the lowered signal of the second source voltage can completely invert the operation of the invertor connected to the first source voltage, thereby eliminating the inconvenience of the output of the voltage conversion circuit assuming an intermediate level.

The first power circuit, as shown in FIG. 5, for example, includes a voltage level generating section 20 for generating source voltages V1 and V2 having different levels, a switch 21 for selecting any one of the voltage levels in accordance with the result of detection by the second power level detection circuit 23, and an amplifier circuit 22 for current-amplifying the selected source voltage. The first power circuit can alternatively include a plurality of source voltage generating circuits for generating source voltages of different levels, and a switch for selecting the output of the source voltage generating circuits in accordance with the result of detection by the second power level detection circuit.

The second power level detection circuit can be realized by a circuit for detecting that the second source voltage decreases below a predetermined value by comparing the output of a constant voltage source in the semiconductor device with the result of dividing the second source voltage by resistors.

The second power circuit, which is, as described above, a boosting circuit having a charge pump circuit, is not limited to such a boosting circuit but may employ a step-down circuit. Also, the power supply for the second power circuit can use an external power supply, or other internal power supply such as the second source voltage output by the first power circuit.

In the dynamic random access memory (DRAM), in testing mode for selecting all word lines, the load capacitance of the boosting circuit is extremely increased. In the case where the power circuit according to the invention is applied to the DRAM so that the second power level detection circuit is activated in accordance with a control signal only at the time of testing, such a test can be conducted easily. In this case, the load capacitance of the boosting circuit does not increase extremely at other than the testing time, and therefore the second power level detection circuit can be deactivated.

Now, an embodiment of the invention applied to the DRAM will be explained. The DRAM according to the embodiment has a configuration as shown in FIG. 1 which has a high-to-low voltage conversion circuit 15 as shown by A of FIG. 2, a part of which has a circuit as shown in FIG. 3. The invention, however, is not limited to this configuration.

Figure 6:
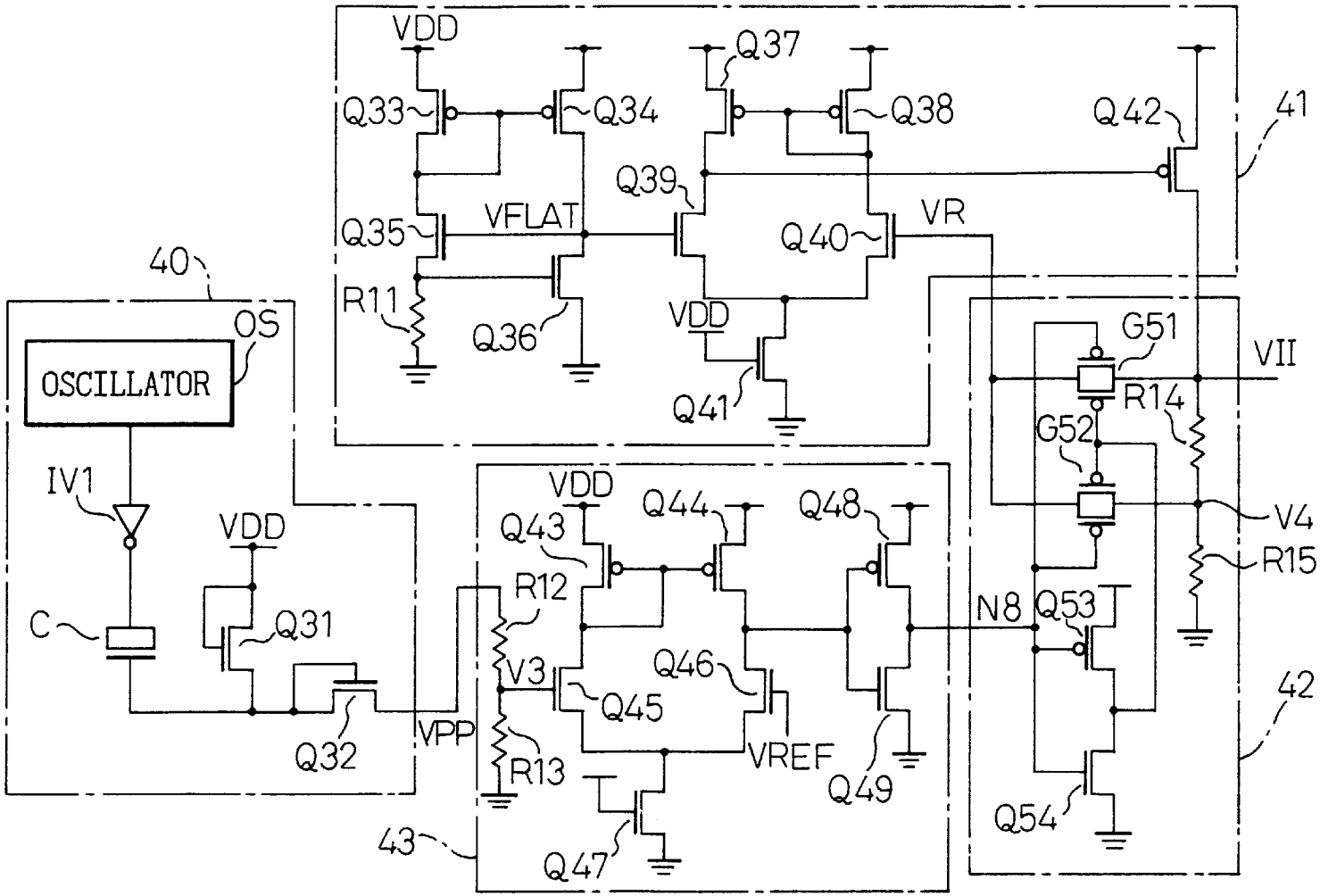
FIG. 6 is a diagram showing a configuration of a power circuit portion according to a first embodiment of the invention.

FIG. 6 is a diagram showing a circuit configuration of the DRAM according to a first embodiment of the invention. In FIG. 6, a VPP power circuit 40 corresponds to the second power circuit 12 of FIGS. 1 and 5, a VPP level detection circuit 43 corresponds to the second power level detection circuit 23 of FIG. 5, and the portions designated by reference numerals 41 and 42 correspond to the first power circuit 11 of FIGS. 1 and 5. Especially, the VII level switching circuit designated by reference numeral 42 corresponds to the voltage dividing circuit 20 using resistors and the switch circuit 21 in FIG. 5, and the VII level generating circuit designated by reference numeral 41 corresponds to the amplifier circuit 22 of FIG. 5.

The VPP power circuit 40 is a well-known boosting circuit, in which an oscillation signal output from an oscillation circuit OS is applied to a capacitor C through a driving inverter IV1. The capacitor C is a transistor with the drain and the source thereof connected to each other. When the output of the inverter IV1 is L, the transistor Q31 turns on and the capacitor C is charged, so that the gate of the capacitor C assumes a potential higher than the drain and the source by a first voltage. Then, when the output of the invertor IV1 turns to H, the gate of the capacitor C which is at a potential higher than the drain and the source assumes a potential higher than the H level by the first voltage. At this time, the transistor Q31 turns off. In this way, the circuit voltage is boosted to a voltage VPP higher than the external power supply VDD. This voltage VPP is supplied through the transistor Q32. The VPP power circuit 40 is not limited to this boosting circuit, but can be any boosting circuit. As long as it can generate a voltage higher than the VII power circuit, it can even be a step-down circuit. Also, although the VPP power circuit 40 is connected between the external power supply VDD and the ground GND in FIG. 6, it may alternatively be connected between the VII power supply and the GND.

The VII level generating circuit 41 includes transistors Q33 to Q36, a constant voltage generating section for generating a constant voltage VFLAT regardless of the external power supply VDD, and an output section including transistors Q37 to Q42 for amplifying the output of the constant voltage generating section. The constant voltage generating section adjusts the current flowing in a resistor R11 and a current mirror circuit including PMOS transistors Q33 and Q34 and outputs the two-stage voltage of the NMOS transistors Q35 and Q36 to VFLAT. The output section compares VFLAT with the level VR output from the VII level switching circuit 42, and adjusts the current flowing in the transistor Q42 in such a way as to equalize the two levels.

The VPP level detection circuit 43 compares the level V3 obtained by dividing the VPP voltage by resistors R12 and R13 with a reference voltage level VREF, and when V3 is lower (VPP is low), outputs a H-level signal as the signal N8. The value of the reference voltage level VREF is set according to the degree of decrease in VPP at which the VII power level is switched. The reference voltage level VREF, therefore, is selected either as a constant level independent of the external source voltage VDD or as a level changing depending on the external source voltage VDD in accordance with the performance required of the device.

The VII level switching circuit 42 selects between switches (transfer gates) G51 and G52 upon receipt of the signal output from the VPP level detection circuit 43 and determines the level VR as VII or as the level obtained by dividing VII by the resistors R14 and R15. In the case where the VPP is output at normal level, N8 is L and the switch G52 is selected, and the level V4 obtained by dividing VII by the resistors R14 and R15 is output as VR. As a result, the transistor Q42 is controlled in such a manner that V4 is VFLAT. Therefore, VII assumes a value of VFLAT×(R1+R2)/R2. In the case where VPP drops, N8 is H and the switch G51 is selected, and VII is output as VR. Thus, VII is equal to VFLAT. In this way, when VPP lowers below a predetermined level, the VII level also lowers.

Figure 7:
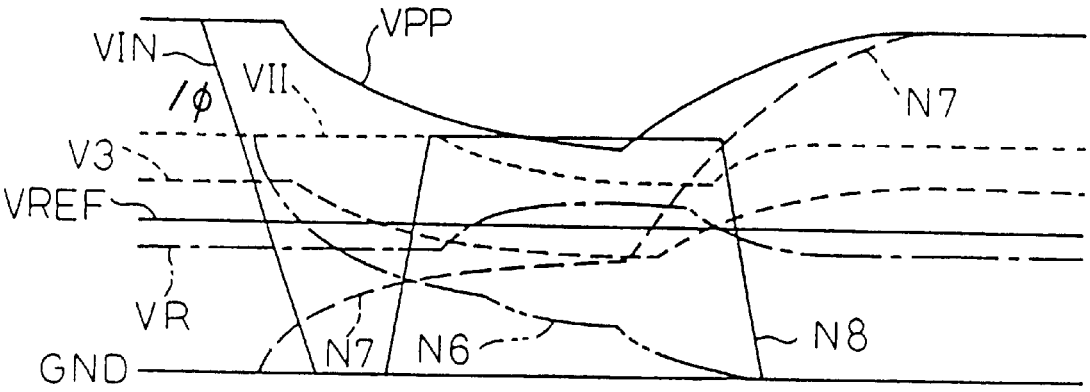
FIG. 7 is a diagram showing operating voltage waveforms of a power circuit according to the first embodiment and circuits using the output of the power circuit.

FIG. 7 is a diagram showing operating voltage waveforms obtained when the circuit of FIG. 3 is driven using the VII power generated in the above-mentioned circuit. As shown, when the signal /ϕ and the input VIN both change to L, VPP lowers. In response, N6 begins to lower and so does V3, so that the N8 of the VPP level detection circuit 43 changes to H. With the change of N8 to H, VII turns to lower level. Accordingly, N6 further lowers, and therefore the transistor Q20 is not turned on. When the charge current decreases, therefore, VPP restores the normal level. Once the VPP restores the normal level, V3 also rises and N8 becomes L, with the result that VII returns to high level. As described above, according to the first embodiment, even when VPP lowers, VII also lowers correspondingly. The transistor Q17 thus positively turns off, so that no short-circuit current flows and the normal state is restored.

Figure 8:
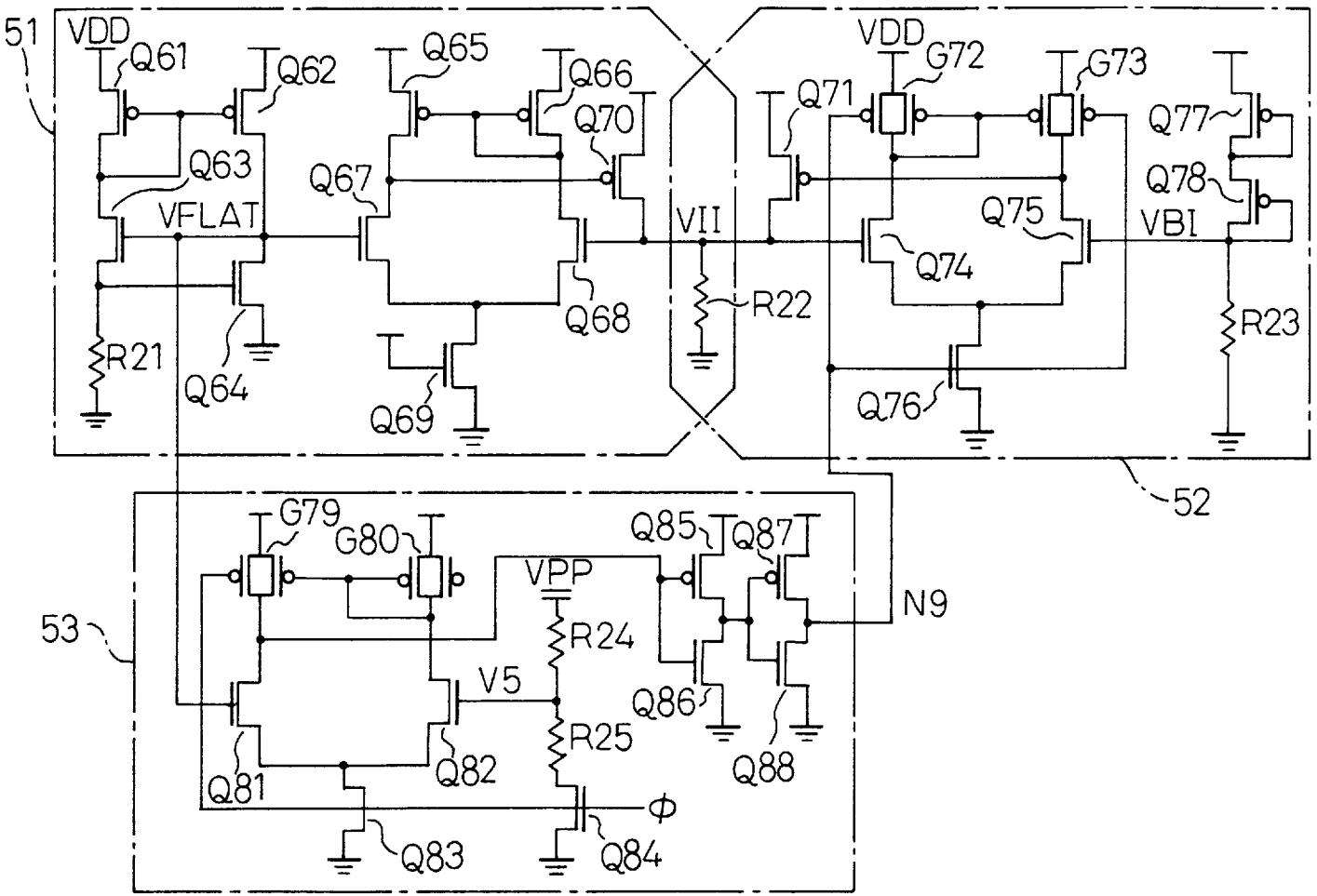
FIG. 8 is a diagram showing a configuration of a power circuit portion according to a second embodiment.

FIG. 8 is a diagram showing a circuit configuration according to the second embodiment of the invention, and shows the portion corresponding to the circuit of the first embodiment shown in FIG. 6, less the VPP level generating circuit. The circuit of the second embodiment includes a first VII level generating circuit 51, a second VII level generating circuit 52 and a VPP level detection circuit 53.

The first VII level generating circuit 51 has a configuration similar to that of the VII level generating circuit 41 of the first embodiment, and includes a constant voltage generating section for generating a fixed voltage VFLAT regardless of the external source voltage VDD and an output section for amplifying the output of the constant voltage generating section. The second VII level generating circuit 52 includes a VBI generating circuit for generating a voltage VBI changing depending on the external source voltage VDD and an output section for amplifying the VBI. The VBI generating section outputs the external source voltage VDD lowered by the level equivalent to the two threshold voltages of the PMOS transistors Q77 and Q78. The output section compares VII level and VBI level and adjusts the output thereof in such a manner as to equalize the two levels.

Figure 9:
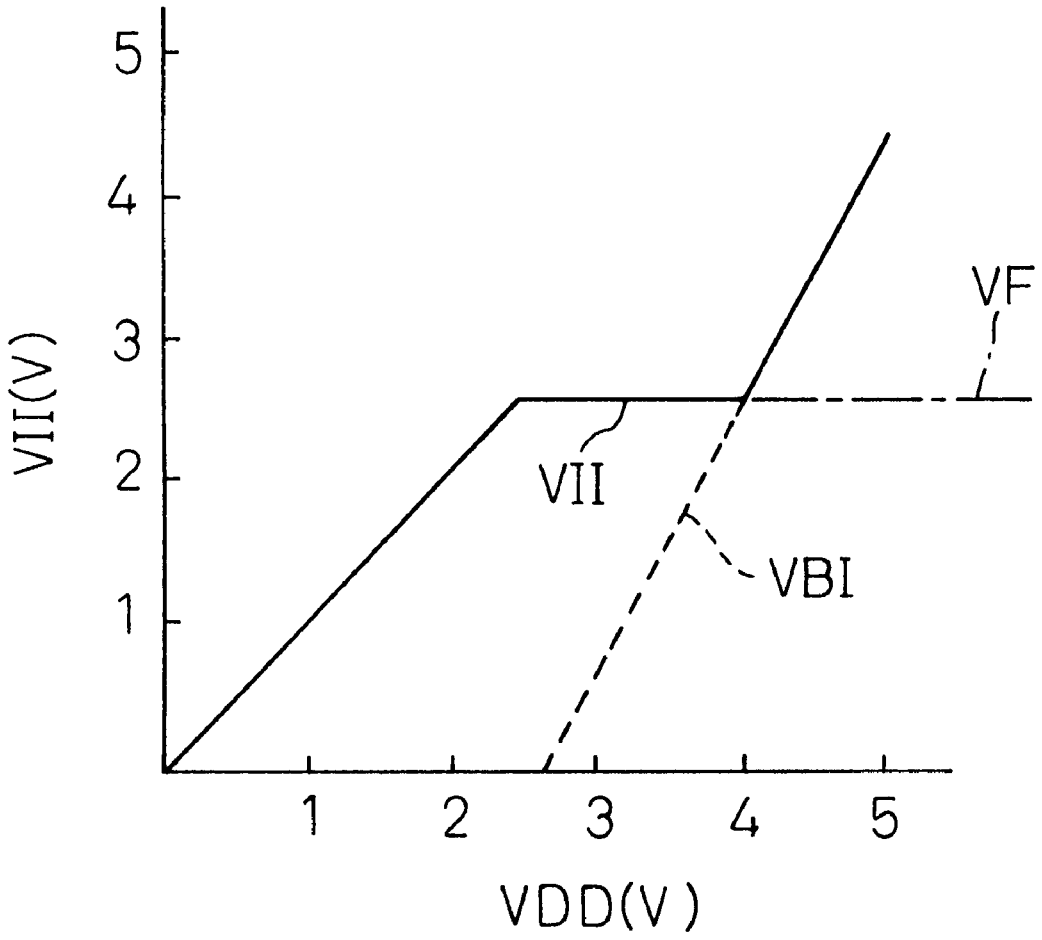
FIG. 9 is a diagram showing the output voltage characteristic of a VII level generating circuit (VII power circuit) according to the second embodiment.

The VPP level detection circuit 53 is activated by the signal ϕ. The VPP level detection circuit 53 compares the VFLAT with the level V5 obtained by dividing the VPP voltage by resistors R24 and R25. When V5 is lower (VPP is low), the signal N9 turns L, while, when the VPP outputs a normal level, the signal N9 turns H. The signal N9 controls the second VII level generating circuit 52, activates the second VII level generating circuit 52 when it is H and deactivates the second VII level generating circuit 52 when it is L. When the signal N9 is H and the second VII level generating circuit 52 is activated, the VII level generating circuit including the first VII level generating circuit 51 and the second VII level generating circuit 52 is configured as an ordinary internal step-down circuit for outputting the VII as shown in FIG. 9 in response to the external source voltage VDD. The output section of the first VII level generating circuit 51 and the second VII level generating circuit 52 constitute an OR-like circuit and produces a higher voltage as VII.

When the signal ϕ turns H, the VPP level detection circuit 53 is activated. At the same time, the decrease in VPP turns the signal to L, and the second VII level generating circuit 52 is deactivated. The VFLAT is often used as a reference voltage for comparison. The signal N9 changes, therefore, when VPP assumes the value of VFLAT×(R3+R4)/R4 or less regardless of the external source voltage VDD. In the circuit configuration of the second embodiment, therefore, VII is turned to low level with the decrease of VPP, only in the area where the output VBI of the second VII level generating circuit 52 is produced as VII (the area not lower than 4 V in FIG. 9) and when ϕ is H.

The device using the circuit of the second embodiment is effective especially for the test to inspect the initial defects. A defect attributable to the fabrication process is liable to develop at high rate in initial stages. After the lapse of the stage of initial defects, defects develop to a comparatively lesser degree. After protracted use, however, a defect related to the durability often occurs again at high rate. In order to eliminate initial defects at the time of shipment, an acceleration test is conducted to artificially develop an initial defect by imposing a certain load on the device. In the DRAM, for example, stress is required to be exerted on all memory cells, and therefore a test, if conducted in an ordinary way, would consume a very long time and entail an increased cost. In order to avoid this inconvenience, many devices have a function exclusive to the stress test in which stress is imposed on all the devices at the same time. Imposition of stress on all the memory cells at the same time requires the simultaneous activation of the word lines. Normally, the word lines of the DRAM are impressed with a high voltage generated in the device, i.e. VPP. When all the word lines are activated at a time, therefore, the current supply capacity of the VPP power supply runs short at the risk of a lowered potential of the VPP power supply. The stress test using this function is conducted by setting the source voltage in the device at a level higher than for normal operation in order to improve the acceleration rate. In the conventional DRAM, the problem of this test is that the voltage of the VPP power supply decreases, and once the output of the voltage conversion circuit comes to fail to decline to a sufficient level, the normal state cannot be restored.

The power circuit according to the second embodiment is suitable for the device on which the acceleration test is conducted. As shown in FIG. 9, in the case where the external source voltage VDD is set higher than VDD in the operation-guaranteed range, the internal source voltage VII is also adapted to rise with a certain coefficient. At the time of a stress test, therefore, the external source voltage VDD is set to 4 V or higher to increase the voltage across the VII power supply, and the signal $\phi$ is turned H, thereby activating the VPP level detection circuit. Then, when VPP lowers at the time of test using the total select function of the word lines, the output voltage of the VII power supply can be reduced to VFLAT and the operation beyond the device capacity can be avoided.

It will thus be understood from the foregoing description that, according to the present invention, there is provided a semiconductor device comprising a VPP power supply and a VII power supply in the device and a logic circuit having the voltage conversion function with the output of an invertor of the VPP power supply connected to the input of an invertor of the VII power supply, wherein stable operation is possible even when the voltage of the VPP power supply declines due to an overload or the like.

What is claimed is:

1. A semiconductor device comprising:

a first power circuit for generating a first source voltage;

a first circuit receiving said first source voltage as a power source;

a second power circuit for generating a second source voltage higher than said first source voltage; and a second power level detection circuit for detecting said second source voltage;

wherein said first power circuit changes said first source voltage in accordance with the result of detection by said second power level detection circuit.

2. A semiconductor device according to claim 1, wherein said first power circuit reduces said first source voltage in accordance with the reduction in said second source voltage so that said first source voltage is lower than said second source voltage.

3. A semiconductor device according to claim 1, further comprising a logic circuit having the voltage conversion function including a first logic gate having said second source voltage as a power supply and a second logic gate having said first source voltage as a power supply and with the input thereof connected to the output of said first logic gate.

4. A semiconductor device according to claim 1, wherein said first power circuit includes a portion for generating potentials V1 and V2 of different levels, a switch for selecting one of said potentials in accordance with the result of detection by said second power level detection circuit, and an amplifier for current-amplifying the selected potential.

5. A semiconductor device according to claim 1, wherein said semiconductor device is configured to be connected to an external power supply, and further comprises a constant voltage source for outputting a constant voltage regardless of a voltage of the external power supply, wherein said second power level detection circuit compares the output of said constant voltage source with the result of dividing said second source voltage by resistors and detecting that said second source voltage has dropped to be at or below a predetermined value.

6. A semiconductor device according to claim 1, wherein said second power circuit is a boosting circuit having a charge pump circuit.

7. A semiconductor device according to claim 1, wherein said second power level detection circuit is activated in accordance with a control signal.

8. A semiconductor device according to claim 7, wherein said semiconductor device is a dynamic random access memory (DRAM) having a plurality of word lines, and said second power level detection circuit is activated in the test mode in which all of the plurality of word lines are selected.

9. A semiconductor device according to claim 2, further comprising a logic circuit having the voltage conversion function including a first logic gate having said second source voltage as a power supply and a second logic gate having said first source voltage as a power supply and with the input thereof connected to the output of said first logic gate.

10. A semiconductor device according to claim 3, wherein said first power circuit includes a portion for generating potentials V1 and V2 of different levels, a switch for selecting one of said potentials in accordance with the result of detection by said second power level detection circuit, and an amplifier for current-amplifying the selected potential.

11. A semiconductor device according to claim 9, wherein said first power circuit includes a portion for generating potentials V1 and V2 of different levels, a switch for selecting one of said potentials in accordance with the result of detection by said second power level detection circuit, and an amplifier for current-amplifying the selected potential.

12. A semiconductor device according to claim 4, further comprising a constant voltage source for outputting a constant voltage regardless of an external power supply, wherein said second power level detection circuit compares the output of said constant voltage source with the result of dividing said second source voltage by resistors and detecting that said second source voltage has dropped to be at or below a predetermined value.

13. A semiconductor device according to claim 9, further comprising a constant voltage source for outputting a constant voltage regardless of an external power supply, wherein said second power level detection circuit compares the output of said constant voltage source with the result of dividing said second source voltage by resistors and detecting that said second source voltage has dropped to be at or below a predetermined value.

14. A semiconductor device according to claim 4, further comprising a constant voltage source for outputting a constant voltage regardless of an external power supply, wherein said second power level detection circuit compares the output of said constant voltage source with the result of dividing said second source voltage by resistors and detecting that said second source voltage has dropped to be at or below a predetermined value.

15. A semiconductor device according to claim 10, further comprising a constant voltage source for outputting a constant voltage regardless of an external power supply, wherein said second power level detection circuit compares the output of said constant voltage source with the result of dividing said second source voltage by resistors and detecting that said second source voltage has dropped to be at or below a predetermined value.

16. A semiconductor device according to claim 11, further comprising a constant voltage source for outputting a constant voltage regardless of an external power supply, wherein said second power level detection circuit compares the output of said constant voltage source with the result of dividing said second source voltage by resistors and detecting that said second source voltage has dropped to be at or below a predetermined value.

17. A semiconductor device according to claim 3, wherein said second power circuit is a boosting circuit having a charge pump circuit.

18. A semiconductor device according to claim 4, wherein said second power circuit is a boosting circuit having a charge pump circuit.

19. A semiconductor device according to claim 5, wherein said second power circuit is a boosting circuit having a charge pump circuit.

20. A semiconductor device according to claim 16, wherein said second power circuit is a boosting circuit having a charge pump circuit.

* * * * *